US008886069B2

(12) United States Patent
Yanagi et al.

(10) Patent No.: US 8,886,069 B2
(45) Date of Patent: Nov. 11, 2014

(54) IMAGE FORMING APPARATUS

(75) Inventors: Yuya Yanagi, Mishima (JP); Yasuhiro Fukase, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 13/489,729

(22) Filed: Jun. 6, 2012

(65) Prior Publication Data

US 2012/0321332 A1 Dec. 20, 2012

(30) Foreign Application Priority Data

Jun. 17, 2011 (JP) ..... 2011-135419

(51) Int. Cl.

| | |
|---|---|
| ***G03G 15/16*** | (2006.01) |
| ***G03G 15/00*** | (2006.01) |
| ***B65H 3/06*** | (2006.01) |
| ***B65H 3/46*** | (2006.01) |

(52) U.S. Cl.

CPC ..... *G03G 15/1605* (2013.01); *G03G 15/6511* (2013.01); *B65H 3/06* (2013.01); *G03G 15/6561* (2013.01); *B65H 2301/5133* (2013.01); *B65H 3/46* (2013.01); *G03G 15/6558* (2013.01)

USPC ..... 399/66; 399/124; 399/302; 399/308; 399/310; 399/313; 399/314; 399/388; 399/393

(58) Field of Classification Search

USPC ..... 399/66, 124, 302, 308, 310, 313, 314, 399/388, 393

See application file for complete search history.

(56) References Cited

U.S. PATENT DOCUMENTS

| | | | |
|---|---|---|---|
| 6,879,801 | B2 | 4/2005 | Soda et al. |
| 8,023,874 | B2 | 9/2011 | Horiuchi |
| 8,155,546 | B2 | 4/2012 | Fukase |
| 8,185,007 | B2 | 5/2012 | Tsukamura et al. |

(Continued)

FOREIGN PATENT DOCUMENTS

| | | | |
|---|---|---|---|
| CN | 1444110 | A | 9/2003 |
| CN | 101373353 | A | 2/2009 |

(Continued)

OTHER PUBLICATIONS

Korean Office Action dated Aug. 12, 2014, in related Korean Patent Application No. 10-2012-0064224.

(Continued)

*Primary Examiner* — Ryan Walsh

(74) *Attorney, Agent, or Firm* — Fitzpatrick, Cella, Harper & Scinto

(57) ABSTRACT

An image forming apparatus includes a main body, a sheet stack unit, an endless intermediate transfer member, a first transfer member for transferring a toner image onto the sheets conveyed from the sheet stack unit, at a nip formed between the intermediate transfer member and the first transfer member, and a second transfer member. In addition, a first voltage applying device applies a voltage to the first transfer member, a second voltage applying device applies a voltage having an opposite polarity to the second transfer member, and a controller controls the first and second voltage applying devices. In a timing when a leading edge of a first sheet reaches the nip, a trailing edge of the first sheet contacts a second sheet conveyed on the sheet stack unit, and wherein a period in which the controller causes the first voltage applying device and the second voltage applying device to apply the voltages to the first transfer member and the second transfer member, respectively, is at least from a time when secondary transfer onto the first sheet is started to a time when the trailing edge of the first sheet stops sliding on the second sheet stacked on the sheet stack portion.

20 Claims, 11 Drawing Sheets

(56) References Cited

U.S. PATENT DOCUMENTS

| | | | | |
|---|---|---|---|---|
| 8,200,101 | B2 | 6/2012 | Ue et al. | |
| 8,224,208 | B2 | 7/2012 | Shimba | |
| 8,472,825 | B2 | 6/2013 | Shimba | |
| 2009/0052921 | A1 | 2/2009 | Nishiwaki | |
| 2009/0060595 | A1* | 3/2009 | Horiuchi | 399/285 |
| 2009/0263149 | A1 | 10/2009 | Makino | |
| 2009/0324259 | A1* | 12/2009 | Ue et al. | 399/9 |
| 2010/0247121 | A1* | 9/2010 | Shimba | 399/43 |

FOREIGN PATENT DOCUMENTS

| | | | |
|---|---|---|---|
| CN | 101587317 | A | 11/2009 |
| CN | 101846942 | A | 9/2010 |
| JP | 11-157686 | A | 6/1999 |
| JP | 2006-259367 | A | 9/2006 |
| JP | 2009-080460 | A | 4/2009 |
| JP | 2009-258473 | A | 11/2009 |
| JP | 2010-011097 | A | 1/2010 |
| JP | 2010-96953 | A | 4/2010 |
| JP | 2010-250269 | A | 11/2010 |

OTHER PUBLICATIONS

Chinese Office Action dated Sep. 2, 2014, in related Chinese Patent Application No. 201210192490.0 (with English translation).

* cited by examiner

CONVENTIONAL TYPE EXAMPLE

EMBODIMENT 1

IMAGE FORMING APPARATUS

BACKGROUND OF THE INVENTION

1. Field of the Invention

The present invention relates to image forming apparatuses that have a function of forming an image on a sheet and are, for instance, copiers and printers.

2. Description of the Related Art

In recent years, image forming apparatuses, such as printers and facsimile machines, have become inexpensive, and widely been used in offices and stores for advertisement and in-house production of catalogs. Along therewith, there are increasing needs not only for high image quality but also for high medium flexibility supporting various types of sheets and for reduction in size to allow installation in a small office and store with a compact space.

Coated sheets (high quality paper sheets onto which gloss coating is applied) have a particularly high need among paper sheets. The coated sheets are characterized by shine, high smoothness and capability of clear reproduction of photographs and characters. Accordingly, the coated sheets are suitable for advertisement and catalogs. Unfortunately, the coated sheets have a problem in that, if a stack of paper is left in a high humidity environment, a surface layer of paper absorbs moisture and is easy to adhere to a paper sheet in contact. Thus, in the conventional type of image forming apparatuses, there is a problem to be solved of double feeding, wherein both the first sheet (hereinafter, referred to as "preceding sheet") conveyed prior to others and the second sheet (hereinafter, referred to as "following sheet") adhered on the first sheet and conveyed after the first sheet are doubly conveyed together.

To address the problem, as disclosed in Japanese Patent Application Laid-Open No. H11-157686, a technique has been proposed that blows air on the sides and top surface of paper sheets stacked on a sheet stack portion to improve sheet separation.

However, there is a case of causing double feeding of coated sheets owing not only to adhesion in a high humidity environment by absorbed moisture but also to adhesion by an electrostatic force. More specifically, in a small image forming apparatus configured such that a preceding sheet in secondary transfer overlaps and is in contact with the following sheet on a sheet stack portion, the preceding and following sheets adhere to each other owing to an electrostatic force in the following cases. That is, the case where a user touches the following sheet with a bare hand, and the case where, even if without touching, material configuring a stack portion has a small resistance and the sheet stack portion is electrically grounded.

It is considered that the double feeding is caused by adhesion due to an electrostatic force unless the sheets are always separated from each other by a sufficient distance during transfer. Thus, separation due to air as disclosed in Japanese Patent Application Laid-Open No. 11-157686 is not a highly reliable measure.

SUMMARY OF THE INVENTION

A purpose of the invention is to suppress double feeding of sheets due to electrostatic adhesion without degrading transfer in an image forming apparatus configured to allow a sheet during secondary transfer to be in contact with and slide on a sheet stacked on a sheet stack portion.

Another purpose of the invention is to provide an image forming apparatus, including a main body of the image forming apparatus, a sheet stack unit including a stack portion on which sheets are stacked, a part of the stack portion being exposed from the main body, an endless intermediate transfer member onto which a toner image is first transferred from an image bearing member, a first transfer member for transferring the toner image from the intermediate transfer member onto the sheet conveyed from the sheet stack unit, at a nip formed between the intermediate transfer member and the first transfer member, a second transfer member opposed to the first transfer member via the intermediate transfer member at the nip, a first voltage applying device that applies a voltage to the first transfer member; and a second voltage applying device that applies a voltage having a polarity opposite to a polarity at the first voltage applying device, to the second transfer member, wherein in a timing when a leading edge of a first sheet reaches the nip, a trailing edge of the first sheet contacts a second sheet conveyed after the first sheet on said sheet stack unit, and the first voltage applying device applies a voltage to the first transfer member, and the second voltage applying device applies a voltage to the second transfer member, to allow the toner image to be secondarily transferred from the intermediate transfer member onto the first sheet at the nip.

A further purpose of the present invention will be apparent with reference to the following description and accompanying drawings.

DESCRIPTION OF THE EMBODIMENTS

Preferred embodiments of the present invention will now be described in detail in accordance with the accompanying drawings.

Embodiments for implementing the present invention will now be described in detail in an exemplary manner with reference to the drawings. Note that dimensions, materials, shapes and relative disposition of configurational components described in the embodiments should be appropriately changed according to the configuration of an apparatus to which the present invention is applied and various conditions. There is no intention to limit the scope of the present invention to the following embodiments.

Figure 1:
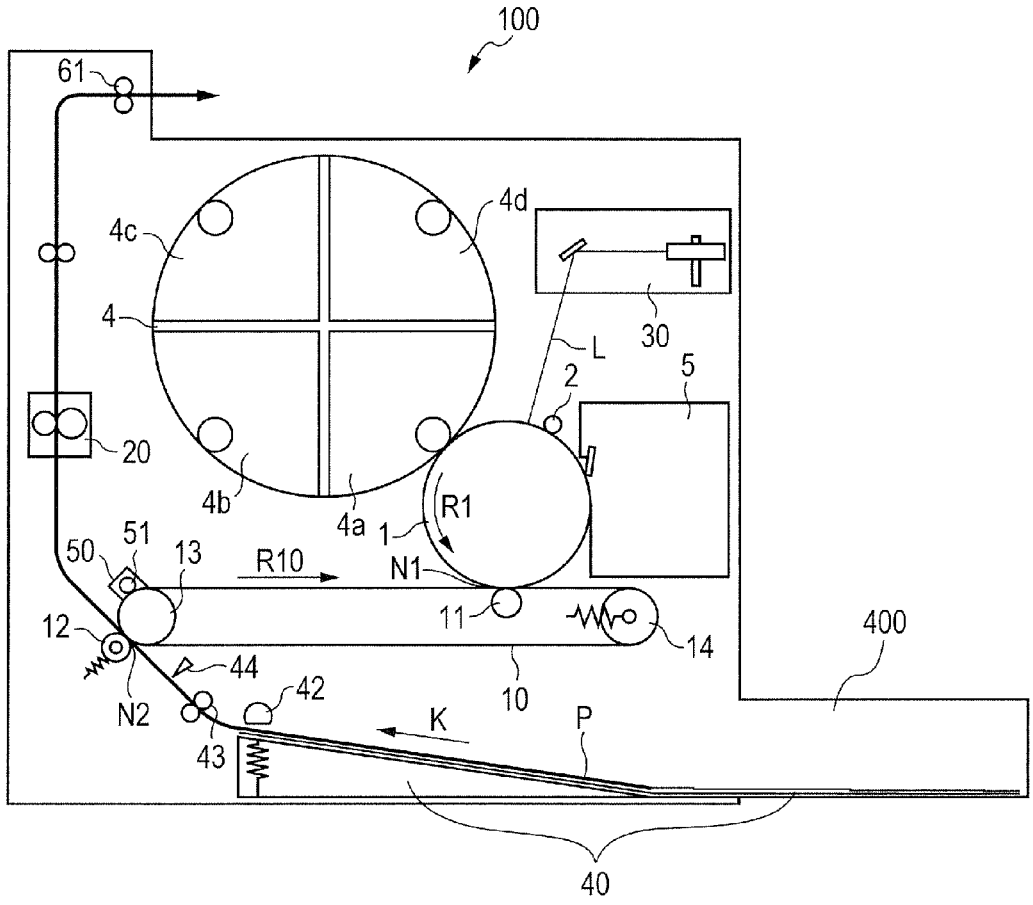
FIG. 1 is a longitudinally sectional view schematically illustrating a configuration of an image forming apparatus according to an embodiment.

FIG. 1 is a longitudinally sectional view schematically illustrating a configuration of an image forming apparatus 100 according to this embodiment. The image forming apparatus 100 illustrated in FIG. 1 is a four-color (four-pass)/full color electrophotographic laser beam printer, and adopts an intermediate transfer system. Hereinafter, the configuration of the image forming apparatus 100 will be briefly described.

The image forming apparatus 100 illustrated in FIG. 1 includes a drum-type electrophotographic photoreceptor (hereinafter, referred to as photosensitive drum) 1 as an image bearing member. The photosensitive drum 1 is rotatably supported by the image forming apparatus 100, and rotationally driven in an arrow R1 direction by a driving unit (not illustrated).

A charge roller 2, an exposure device 30, a developing device 4, an intermediate transfer belt (intermediate transfer member) 10 and a photosensitive drum cleaning device 5 are arranged around the photosensitive drum 1 substantially along the rotational direction.

Here, the charge roller 2 is a contact roller for uniformly charging the surface of the photosensitive drum 1. The exposure device 30 irradiates the surface of the photosensitive drum 1 with laser light L to form an electrostatic latent image according to image information. The developing device 4 is for allowing toner to adhere to the electrostatic latent image formed on the surface of the photosensitive drum 1 to develop a toner image. The intermediate transfer belt 10 is for first transfer of the toner image (developer image) borne on the photosensitive drum 1 (image bearing member). This belt is endless and provided so as to be rotatable. The photosensitive drum cleaning device 5 is for removing toner after first transfer that remains on the surface of the photosensitive drum 1.

A first transfer roller 11 is arranged in the intermediate transfer belt 10. This roller 11 presses the intermediate transfer belt 10 against the surface of the photosensitive drum 1 to form a first transfer nip N1 between the photosensitive drum 1 and the intermediate transfer belt 10. A first transfer bias voltage is applied to the first transfer roller 11 by a power source (not illustrated).

A secondary transfer roller 12 is arranged outside the intermediate transfer belt 10. A secondary transfer nip N2 is formed between a driving roller 13 and the secondary transfer roller 12 via the intermediate transfer belt 10. The driving roller 13 is a stretching roller arranged on the inner surface of the intermediate transfer belt 10. Here, the secondary transfer roller 12 corresponds to a secondary transfer member for secondarily transferring, on a sheet, the toner image having been first transferred onto the intermediate transfer belt 10, at the secondary transfer nip N2 formed between this roller 12 and the intermediate transfer belt 10. A second transfer bias voltage is applied to the secondary transfer roller 12 by a power source not illustrated. The driving roller 13 corresponds to an opposite member provided opposite to the secondary transfer roller 12 via the intermediate transfer belt 10.

Furthermore, an intermediate transfer belt cleaning device 50 is provided opposite to the intermediate transfer belt 10. Here, a cleaning roller 51 is arranged as an intermediate transfer belt cleaning device. The cleaning roller 51 is a charging member that charges remaining toner after secondary transfer. The secondary transfer roller 12 and the cleaning roller 51 have a configuration capable of contacting with and separating from the intermediate transfer belt 10.

A fixing device 20 is arranged downstream of the secondary transfer nip N2 in the sheet P conveying direction (arrow K direction). The fixing device 20 is for heating and pressurizing the toner image transferred onto the sheet P to fix the image.

An operation of the image forming apparatus 100 will now be described.

A charging bias voltage of superposition of DC and AC voltages is applied to the charge roller 2, thereby allowing the photosensitive drum 1 rotationally driven in the arrow R1 direction to be charged uniformly over the surface. When a yellow image signal is input into a laser oscillator (not illustrated), laser light L is emitted, the charged surface of the photosensitive drum 1 is irradiated with the light to form an electrostatic latent image.

When the photosensitive drum 1 further rotates in the arrow R1 direction, a yellow development device 4*a* adds yellow toner to the electrostatic latent image on the photosensitive drum 1 to develop a toner image. The yellow toner image on the photosensitive drum 1 is first transferred onto the intermediate transfer belt 10 via the first transfer nip N1 by the first transfer bias voltage applied to the first transfer roller 11. Remaining toner after first transfer on the surface of the photosensitive drum 1 after toner image transfer is removed by a photosensitive drum cleaning device 5 and supplied to the next image formation.

The series of image formation processes of charging, exposure, development, first transfer and cleaning is repeated for the other three colors, which are magenta, cyan and black. This repetition overlaps the four-color toner images on the intermediate transfer belt 10.

During the first transfer process where the yellow, magenta and cyan toner images are overlapped on the intermediate transfer belt 10, the secondary transfer roller 12 and the cleaning roller 51 are separated from the intermediate transfer belt 10. The rollers contact therewith during first transfer for the last color, black.

Subsequently, the four-color toner image on the intermediate transfer belt 10 is secondarily transferred onto the sheet (recording material) P, having been conveyed (fed) in the arrow K direction from a sheet stack portion 40 in a sheet stack unit 400 through the secondary transfer nip N2 by the second transfer bias voltage supplied by the power source to the secondary transfer roller 12. The sheet picked up from the sheet stack portion 40 by a pick-up roller 42, which is a conveyance device, is guided by a conveying follower roller 43 and reaches the secondary transfer nip N2. The sheet stack unit 400 includes the stack portion 40 on which sheets are stacked. A part of the sheet stack portion 40 is exposed from a main body of the image forming apparatus. When the pick-up roller 42 picks up a sheet, the sheet to be picked up contacts with and slides on the following sheet stacked on the stack portion.

Figure 2:
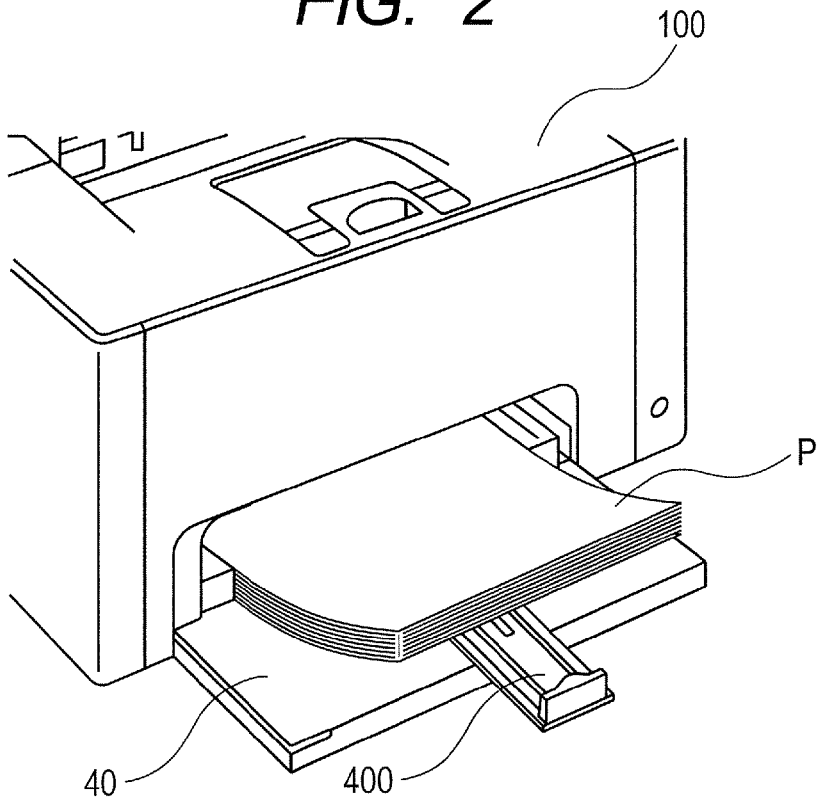
FIG. 2 is a perspective view of the image forming apparatus in FIG. 1.

FIG. 2 is a perspective view of the image forming apparatus 100 in FIG. 1 for illustrating the sheet stack unit 400 and the stack portion 40. As illustrated in FIG. 2, the part of the stack portion 40 of the sheet stack unit 400 is exposed from the main body of the image forming apparatus. The length between the secondary transfer nip N2 and the stack portion 40 in the sheet conveying direction is shorter than the length of the sheet stacked on the stack portion. As illustrated in FIGS. 1 and 2, when the leading edge of the sheet reaches the secondary transfer nip N2, the trailing edge of the sheet is exposed from the main body of the image forming apparatus.

The sheet P onto which the toner image has been transferred by the secondary transfer nip N2 is conveyed to the fixing device 20. At the device 20, the sheet P is heated and pressurized to be fusion-fixed (fixed). The fixation acquires a four-color/full color image on the sheet P.

Meanwhile, remaining toner after secondary transfer, having not been transferred onto the sheet P, remains on the intermediate transfer belt 10 on which the toner image has been transferred. The remaining toner after secondary transfer on the intermediate transfer belt is charged by the intermediate transfer belt cleaning device 50. In the case where the charge polarity of toner during development (here, negative polarity) is a regular charge polarity, the cleaning device 50 charges the remaining toner after secondary transfer to the opposite polarity (positive polarity). The toner is collected by the photosensitive drum cleaning device 5 via the photosensitive drum 1.

That is, the opposite polarity, which is of positive charges, is applied to the remaining toner after secondary transfer by the cleaning device 50, thereby moving the toner onto the photosensitive drum 1 through the first transfer nip N1. The remaining toner after secondary transfer, having moved onto the photosensitive drum 1, is removed together with the remaining toner after first transfer on the photosensitive drum 1, by the photosensitive drum cleaning device 5. The cleaning device 50 may be a cleaning blade.

Figure 3:
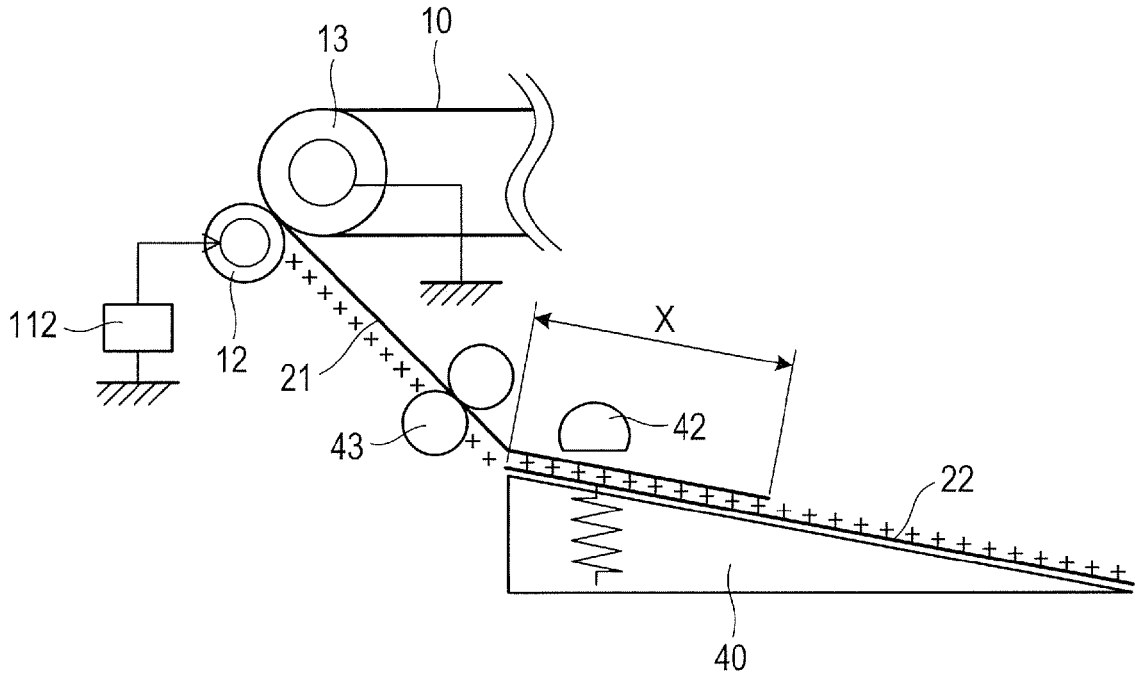
FIG. 3 is a schematic diagram illustrating a previous secondary transfer section in an image forming apparatus.

FIG. 3 illustrates a schematic configuration of a previous secondary transfer section in the image forming apparatus 100. A mechanism of causing double feeding owing to electrostatic adhesion will now be described.

Among paper sheets, coated sheets include highly conductive coating applied onto the sheet surfaces. The surface has characteristics of lower resistance and higher conductivity than those of a base layer. The transfer bias voltage having the positive polarity is applied to the secondary transfer roller 12 by a transfer bias voltage applying device 112, which is a first voltage applying device, the secondary transfer is started, and positive charges are injected into a preceding sheet 21.

The positive charges flow to the trailing edge of the sheet. In the case where rollers (not illustrated) contacting with the preceding sheet 21 in the secondary transfer and a conveying guide (not illustrated) have high insulation property and there is no path for charges to escape, the entire coated sheet is charged.

In the case where the conveying distance from the sheet stack portion 40 to the secondary transfer nip N2 is short, the trailing edge portion of the preceding sheet 21 (upstream end in the sheet conveying direction) overlaps with a following sheet 22 at an overlapping amount X in the secondary transfer of the preceding sheet 21, depending on a certain sheet size.

Here, the following sheet 22 is stacked on the sheet stack portion 40. During secondary transfer of the preceding sheet 21, the trailing edge of the preceding sheet 21 can contact with and slide on the following sheet 22. The preceding sheet 21 is secondarily transferred at the secondary transfer nip N2. For the sake of description, the preceding sheet 21 and the following sheet 22 are thus referred to. However, this reference does not limit the scope to conveyance of a sheet in continuous printing. In this embodiment, the following sheet 22 is the top sheet stacked on the sheet stack portion 40.

The overlapping amount X becomes smaller as the preceding sheet 21 is conveyed downstream. Although the amount finally becomes zero, charges flow into the entire sheets stacked on the sheet stack portion 40 by contact with the preceding sheet 21 during the contact. In the case where the sheet stack portion 40 has a high insulation property, the entire stacked sheets are positively charged. In the case where the charge amount of the sheet is large, the surface potential of the sheet becomes high.

Figure 4A:
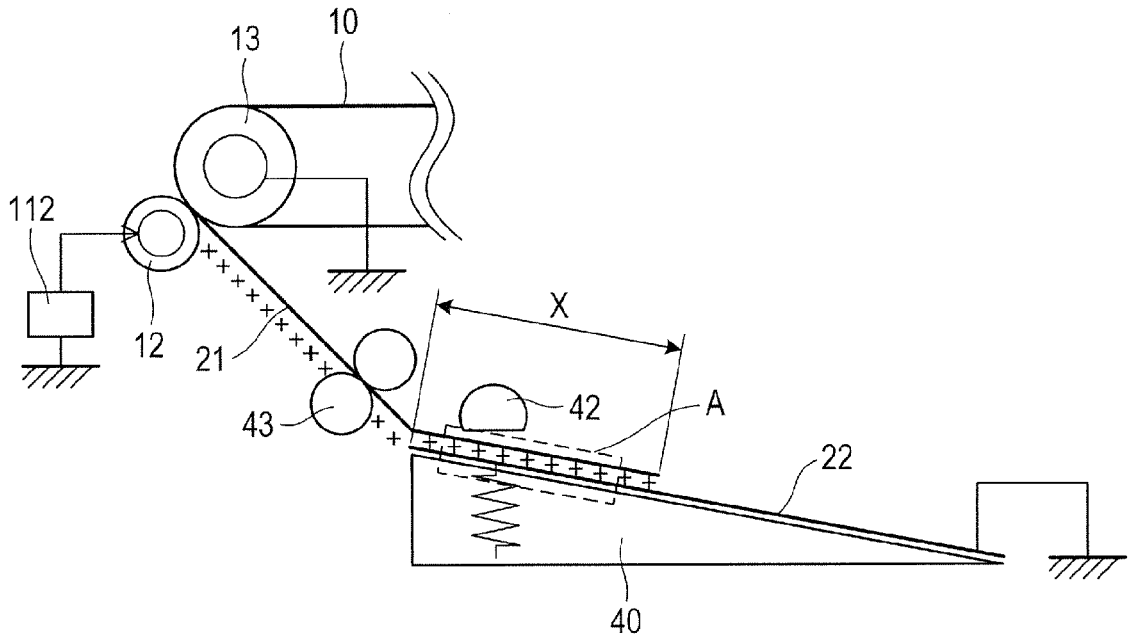
FIGS. 4A and 4B are schematic diagrams illustrating a state where a following sheet is grounded in the previous secondary transfer configuration.
Figure 4B:
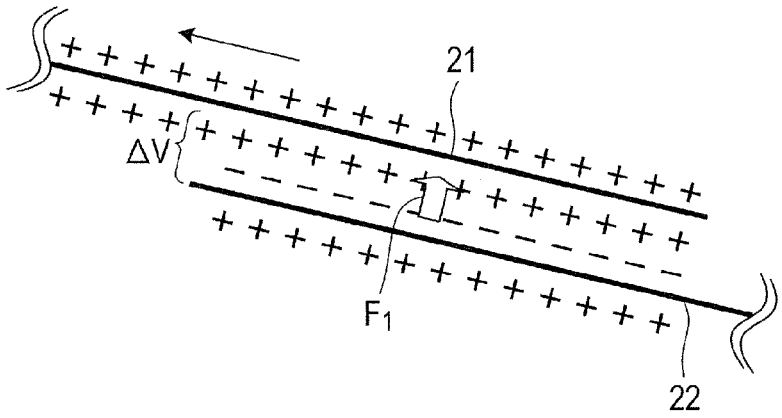

The secondary transfer section in the case where a user touches the following sheet 22 in the sheet stack portion 40 with a bare hand in the secondary transfer of the preceding sheet 21 under the aforementioned condition will now be described with reference to FIGS. 4A and 4B. FIG. 4A is a schematic sectional view illustrating a state where the preceding sheet 21 is in the secondary transfer and the following sheet 22 is electrically grounded. FIG. 4B is an enlarged diagram of a part A in FIG. 4A, which illustrates a state where the preceding sheet 21 and the following sheet 22 are charged.

If the following sheet 22 on the sheet stack portion 40 is touched with the bare hand, the charges escape through the human body to electrically neutralize the sheet and thereby the surface potential of the following sheet temporarily becomes zero. This situation is as with the case where the following sheet 22 is electrically grounded as in FIG. 4A.

Immediately thereafter, induction phenomenon occurs in which the surface of the following sheet 22 opposite to the preceding sheet 21 is negatively charged and the back face of the following sheet is positively charged as illustrated in FIG. 4B.

As a result, a potential difference ΔV occurs between the bottom surface (positive polarity) of the preceding sheet 21 and the top surface (negative polarity) of the following sheet 22. The following sheet 22 is dragged by the preceding sheet 21 owing to a strong electrostatic force $F_1$, and conveyed while adhering thereto, thereby causing double feeding. The electrostatic force $F_1$ is proportional to the potential difference ΔV.

In the case where the following sheet 22 on the sheet stack portion 40 is not touched with a bare hand, double feeding may sometimes occur owing to electrostatic adhesion. This feeding may occur in the case where the surface (volume) resistance of material of the sheet stack portion 40 is small and the sheet stack portion 40 is grounded. In such a case, the charges may escape from the positively charged sheet along the creepage surface (inside) of the sheet stack portion 40, thereby causing a potential difference with the preceding sheet 21 in the secondary transfer. This difference may cause electrostatic adhesion.

According to the above description, the smaller the transfer bias application amount applied by the transfer bias voltage applying device 112, the smaller the charge amount onto the preceding sheet 21 and the charge amount (surface potential) of the following sheet 22 charged by contact with the preceding sheet 21 become. In this state, according to the aforementioned cause, the potential difference ΔV between the preceding sheet 21 and the following sheet 22, which occurs in a situation where the charges escape from the following sheet 22, also becomes smaller. As a result, the electrostatic force $F_1$ also becomes smaller. Since the preceding sheet 21 and the following sheet 22 do not electrostatically adhere to each other, it is understood that double feeding can be avoided.

However, if the transfer bias application amount is small, transfer efficiency drops, thereby causing faulty transfer.

That is, to fundamentally solve the problem, it is required to reduce the surface potential of the sheet, while maintaining the potential difference between the secondary transfer roller 12 and the intermediate transfer belt 10 that is necessary for transfer.

Embodiment 1

Embodiment 1 will now be described.

Figure 5:
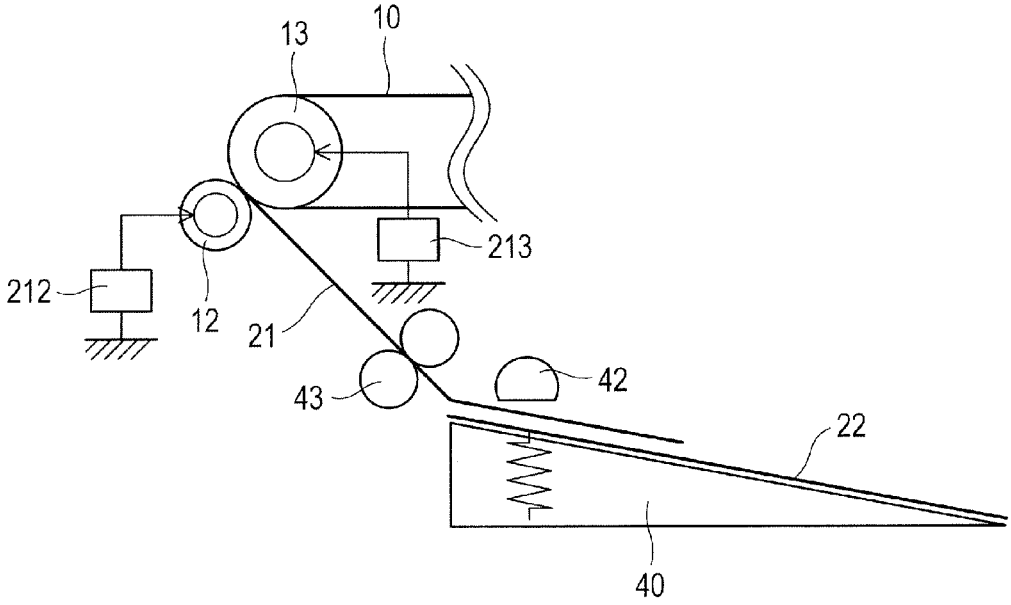
FIG. 5 is a diagram for illustrating a configuration of a secondary transfer section in Embodiment 1.

FIG. 5 is a diagram for illustrating a configuration of a secondary transfer section specific to this embodiment.

As illustrated in FIG. 5, the secondary transfer roller 12 is connected to a first transfer bias voltage applying device 212, which is a first voltage applying device, as with the configuration in the previous configuration. A bias voltage (first voltage) with the positive polarity is applied to the secondary transfer roller 12.

This embodiment is different from the previous example in that a second transfer bias voltage applying device 213 as a second voltage applying device is connected to the driving roller 13 as the opposite member, to which a bias voltage (second voltage) with the negative polarity is applied.

Figure 6:
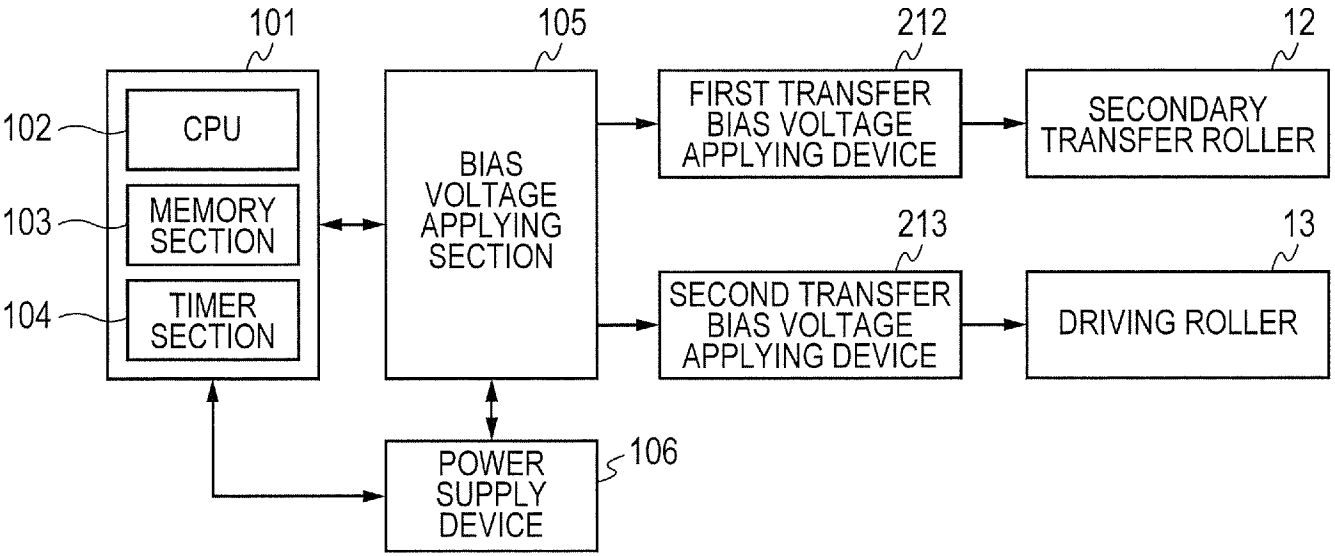
FIG. 6 is a block diagram for illustrating control in Embodiment 1.

FIG. 6 is a block diagram illustrating control according to which the first transfer bias voltage and the second transfer bias voltage are applied to the secondary transfer roller 12 and the driving roller 13, respectively.

A controller 101 as a control unit includes a CPU 102, a memory section 103 and a timer section 104.

The CPU 102 issues control signals to each component of the image forming apparatus, thereby performing operation. The memory section 103 includes a Read Only Memory (ROM), a Random Access Memory (RAM) and a hard disk drive (HDD), and stores a control program. The RAM is a nonvolatile memory, loads and stores the control program for operation by the CPU 102. The timer section 104 measures the start and finish time points and time periods of applying the first and second transfer bias voltages. A bias voltage applying controller 105 is connected to the CPU 102 in a manner capable of communication, and receives an operation instruction from the CPU 102.

The voltage supplied from the power supply device 106 is boosted by the first and second transfer bias voltage applying devices 212 and 213 and prescribed bias voltages are applied to the secondary transfer roller 12 and the driving roller 13.

Figure 7:
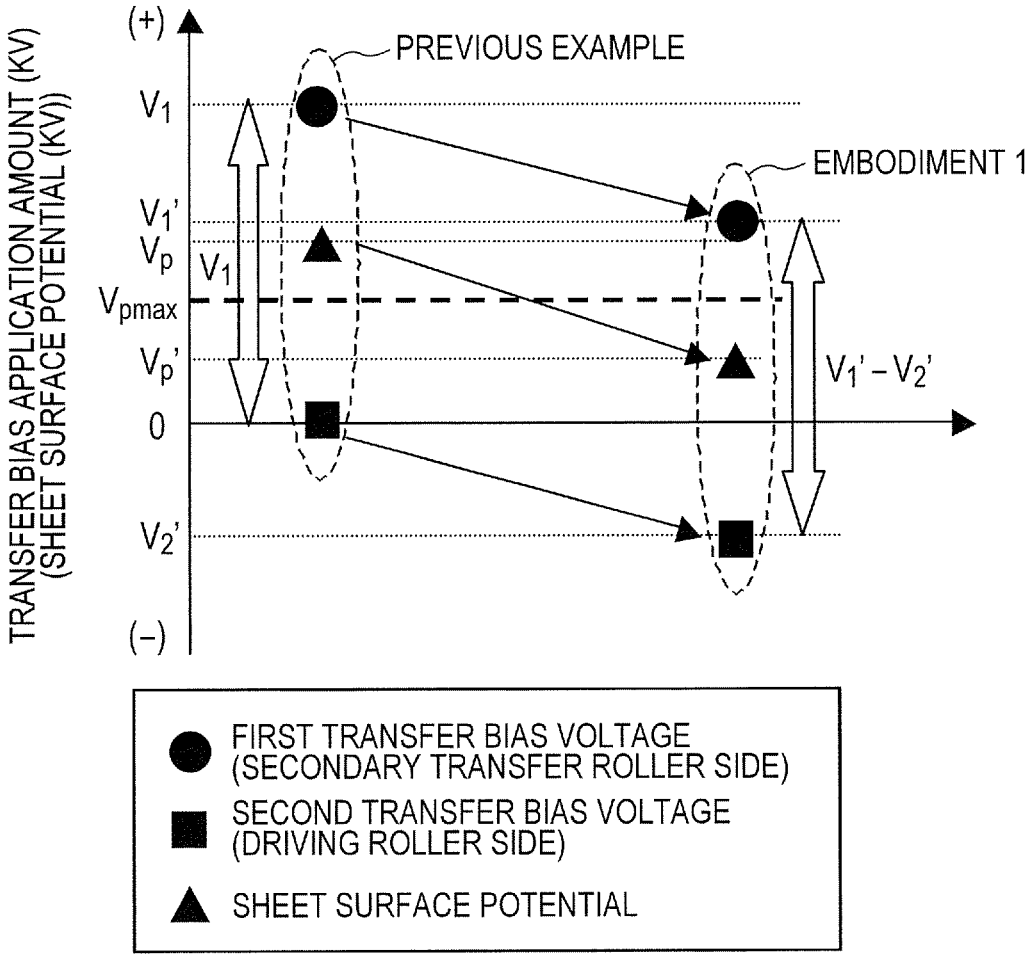
FIG. 7 is a diagram illustrating a relationship between a transfer bias application amount and the surface potential of the following sheet.

Next, referring to FIG. 7, advantageous effects of Embodiment 1 are described according to comparison with the previous example on a relationship between the transfer bias application amount and the surface potential of the following sheet 22.

FIG. 7 is a diagram illustrating the relationship between the transfer bias application amount and the surface potential of the following sheet 22.

The transfer bias application amount by the transfer bias voltage applying device 112 in the previous example is $V_1$ (the driving roller 13 is at 0 (V) because this roller is grounded). The potential difference $V_1$ can transfer a toner image from the intermediate transfer belt 10 onto the sheet (coated sheet) with no problem.

The surface potential of the following sheet 22 stacked on the sheet stack portion 40 is $V_P$ when the toner image on the intermediate transfer belt 10 is secondarily transferred onto the preceding sheet 21(coated sheet) under the above condition. As described above, in the previous example (transfer bias application amount $V_1$), the surface potential $V_P$ of the following sheet 22 is higher than the maximum surface potential absolute value (threshold) $V_{Pmax}$ of a sheet at which double feeding is not caused even with touch by a bare hand. Accordingly, double feeding is caused owing to electrostatic adhesion.

Thus, in this embodiment, the following setting is made. Here, the first transfer bias voltage application amount applied to the secondary transfer roller 12 is $V_1'$(>0). The second transfer bias voltage application amount applied to the driving roller 13 is $V_2'$ (<0). The surface potential of the following sheet 22 is $V_P'$. In this case, parameters are set so as to satisfy following expressions, $$V_1'-V_2'=V_1, \text{ and}$$

$$V_P' \leq V_{Pmax}.$$

That is, the first transfer bias voltage application amount $V_1'$ and the second transfer bias voltage application amount $V_2'$ have polarities opposite to each other. The potential difference between the secondary transfer roller 12 and the driving roller 13 is set to a potential difference at which a toner image can be transferred from the intermediate transfer belt 10 onto the sheet with no problem.

In other words, application of the transfer bias voltage having the negative polarity to driving roller 13 reduces transfer bias application amount having the positive polarity that is applied to the secondary transfer roller 12. This application reduces the surface potential (absolute value) of the sheet during the secondary transfer, while maintaining the potential difference required for the secondary transfer. (First mode)

In the configuration of this embodiment, under a condition where 10 coated sheets (basis weight of 130 g) pass, the first and second transfer bias voltage application amounts are adjusted, and presence or absence of electrostatic adhesion double feeding is determined in the case where the following sheet 22 is touched with a bare hand when the absolute value of the surface potential of the following sheet 22 is changed. Table 1 illustrates the result of the experiment.

TABLE 1

| | Absolute value of sheet surface potential (V) | | | | |
|---|---|---|---|---|---|
| | 1000 | 800 | 400 | 300 | 200 |
| Occurrence of double feeding due to electrostatic adhesion | Positive | Positive | Positive | Negative | Negative |

According to the result of the experiment in Table 1, it is understood that, in the case where the absolute value of the surface potential of the following sheet 22 is 300 (V) or less, double feeding does not occur even if the following sheet 22 is touched with a bare hand.

Accordingly, in this embodiment, it is set such that the maximum surface potential is $V_{Pmax}$=300 (V).

Figure 8A:
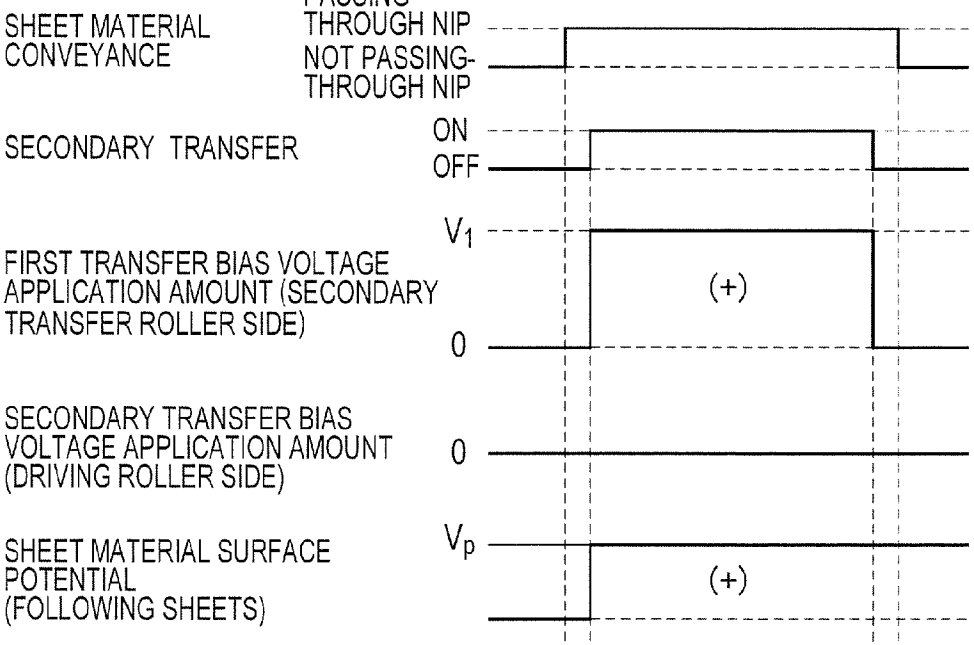
FIGS. 8A and 8B are diagrams for illustrating transfer bias voltage application timing.
Figure 8B:
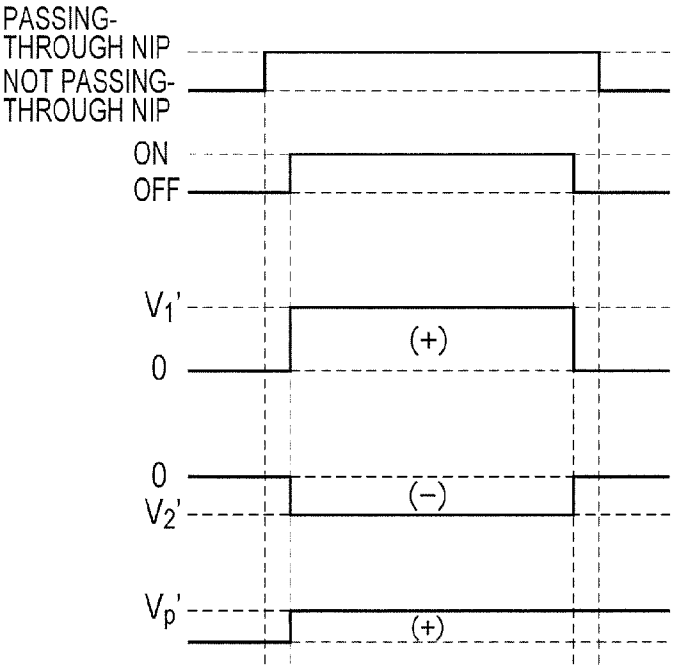

Next, the bias voltage applying times of the first transfer bias voltage application amount $V_1'$ and the second transfer bias voltage application amount $V_2'$ will be described with reference to FIGS. 8A and 8B, which is a timing chart in the case of secondary transfer of one sheet. FIG. 8A illustrates the previous example. FIG. 8B illustrates the case of this embodiment.

According to FIGS. 8A and 8B, there is no difference between both the cases in that a bias voltage is applied to reach a prescribed bias voltage until the secondary transfer of the conveyed and fed sheet is started, and the bias application is finished after completion of the secondary transfer.

In the case of the previous example in FIG. 8A, during the secondary transfer of the preceding sheet 21, the transfer bias voltage is continuously applied at the application amount $V_1$ (positive polarity) to the secondary transfer roller 12. Accordingly, the surface potential of the following sheet 22 on the sheet stack portion 40 is maintained to a level $V_p$ at which electrostatic adhesion occurs. Even after completion of the secondary transfer, substantially the same surface potential is maintained, in the case where the charges do not escape. There is always a possibility of double feeding due to electrostatic adhesion during the secondary transfer of the preceding sheet 21.

In contrast, in the case of this embodiment in FIG. 8B, during the secondary transfer of the preceding sheet 21, the first transfer bias voltage is continuously applied to the secondary transfer roller 12 at the application amount $V_1'$ (positive polarity), and the second transfer bias voltage is applied to the driving roller 13 at the application amount $V_2'$ (negative polarity). During the secondary transfer of the preceding sheet 21, the surface potential of the following sheet 22 is $V_P'$ ($\leq V_{Pmax}$). Accordingly, double feeding due to electrostatic adhesion does not occur.

In order to prevent double feeding due to electrostatic adhesion from occurring, it is desirable that the time period of applying the first transfer bias voltage application amount $V_1'$ and the second transfer bias voltage application amount $V_2'$ be at least a period from the time when the secondary transfer of the preceding sheet 21 is started to the time when the overlapping where the preceding sheet 21 and the following sheet 22 to contact and slide with and on each other in the sheet conveying direction is canceled. Accordingly, after the preceding sheet 21 becomes in a state of not overlapping and contact with and slide on the following sheet 22 in the conveying direction, the transfer bias voltage may be applied only to the secondary transfer roller 12 at the application amount $V_1$ (positive polarity) as with the previous example, or the transfer bias voltage may be applied only to the driving roller 13 at the application amount $V_1$ (negative polarity). (Second mode). In this case, the application amount $V_1$ (positive polarity) of the transfer bias voltage applied only to the secondary transfer roller 12, or the application amount $V_1$ (negative polarity) of the transfer bias voltage applied only to the driving roller 13 becomes larger than the amount in the case of applying on both the rollers.

Figure 9A:
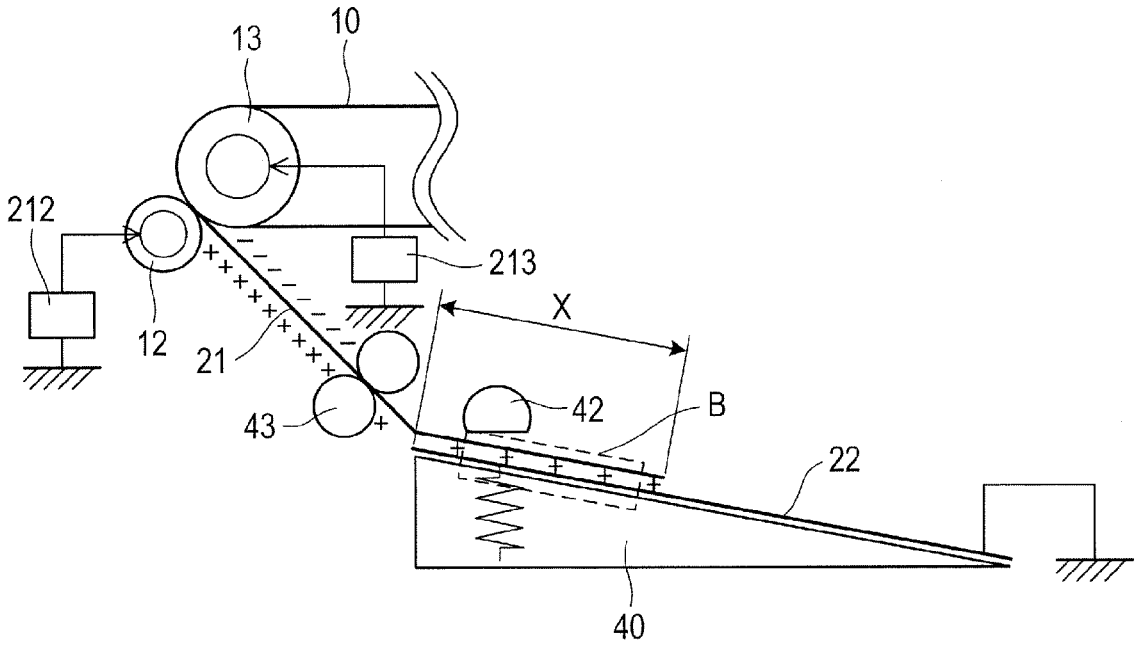
FIGS. 9A and 9B are schematic diagrams illustrating a state where a following sheet is grounded in the secondary transfer configuration of Embodiment 1.
Figure 9B:
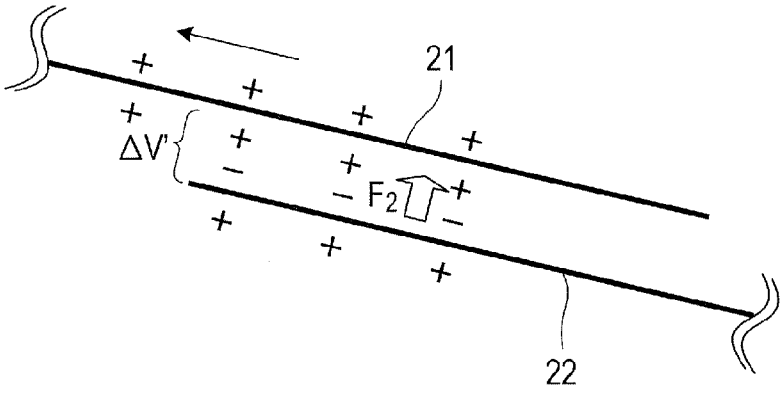

FIG. 9A illustrates a diagram of a state of the secondary transfer section in the image forming apparatus 100 where the following sheet 22 is touched with a bare hand in the secondary transfer of the preceding sheet 21 (in the case where the following sheet 22 is grounded). FIG. 9B illustrates a charging state of the preceding sheet 21 and the following sheet 22.

Even in the case where the following sheet 22 is grounded and the surface of the following sheet 22 opposite to the preceding sheet 21 is negatively charged as with the previous example, the surface potential of the preceding sheet 21 is low and the potential difference $\Delta V'$ between the preceding sheet 21 and the following sheet 22 is small. Accordingly, an electrostatic force $F_2$ does not become large enough to cause double feeding.

The method described above can prevent double feeding due to electrostatic adhesion without degrading transfer capability.

Next, environment (temperature and humidity) dependence of double feeding of a coated sheet due to electrostatic adhesion will be described. As described above, parameters related to double feeding due to electrostatic adhesion are the potential difference between the secondary transfer roller 12 and the intermediate transfer belt 10 that is required for secondary transfer, and the resistance of the surface of the sheet.

First, the potential difference between the secondary transfer roller 12 and the intermediate transfer belt 10, which is required for transfer, may sometimes be controlled to allow a prescribed current to flow to the secondary transfer section to acquire high image quality irrespective of the environment (temperature and humidity). This control is made because the resistance of a transfer member, such as the secondary transfer roller 12, varies according to the temperature and humidity.

Table 2 illustrates a relationship between the resistance of the surface of the sheet, the potential difference between the secondary transfer roller 12 and the intermediate transfer belt 10, which is required for secondary transfer, and the probability of double feeding due to electrostatic adhesion, for each environment.

TABLE 2

| | Sheet resistance | Potential difference required for transfer | Probability of double feeding due to electrostatic adhesion |
|---|---|---|---|
| High humidity environment (humidity of 80%) | Small (disadvantageous to prevent double feeding) | Small (advantageous to prevent double feeding) | Hardly to occur |
| Medium humidity environment (humidity of 50%) | Medium | Medium | Easily to occur |
| Low humidity environment (humidity of 10%) | Large (advantageous to prevent double feeding) | Large (disadvantageous to prevent double feeding) | Hardly to occur |

In a high humidity environment with a humidity of about 80%, the resistance of the transfer member, such as the secondary transfer roller 12, decreases and allows the current to easily flow. Accordingly, the potential difference between the secondary transfer roller 12 and the intermediate transfer belt 10 may be small, which is advantageous to prevent double feeding due to electrostatic adhesion (hardly to cause double feeding). In contrast, in the low humidity environment with a humidity of about 10%, the resistance of the transfer member, such as the transfer roller 12, increases and the current is difficult to flow. Accordingly, the potential difference between the secondary transfer roller 12 and the intermediate transfer belt 10 is required to be increased, which is disadvantageous to prevent double feeding (easily to cause double feeding).

Meanwhile, in the high humidity environment, the resistance of the surface of the sheet decreases owing to moisture absorption by the sheet, and charges are easy to flow to the following sheet, which is disadvantageous to prevent double feeding. In the low humidity environment, the moisture is low because the sheet is dry. Accordingly, the resistance of the surface of the sheet increases, and the charges are difficult to flow to the trailing edge of the sheet, which is advantageous to prevent double feeding.

As described above, in the high and low humidity environments that are not assumed in an office environment, the conditions advantageous and disadvantageous to prevent double feeding coexist, and cancel each other. Accordingly, double feeding due to electrostatic adhesion hardly occurs. In contrast, in the environment with a humidity around 50% that is typical in an office, the conditions advantageous and disadvantageous to prevent double feeding do not cancel each other. Accordingly, double feeding due to electrostatic adhesion easily occurs.

This embodiment therefore sets the first and second transfer bias voltages such that the surface potential of the following sheet 22 on the sheet stack portion 40 is a level or less at which double feeding due to electrostatic adhesion does not occur, and the transfer capability is satisfied, in an environment for typical usage in an office.

Thus, the surface potential of the sheet during transfer can be reduced without degrading the transfer capability. Accordingly, double feeding and miss-feeding due to electrostatic adhesion can be securely prevented irrespective of the environment.

This embodiment has described the configuration in which the toner is charged to the negative polarity. However, the configuration is not limited thereto. More specifically, even in the case where the toner is charged to the positive polarity, the configuration in which the first transfer bias voltage is applied to the secondary transfer roller at the application amount $V_1'$ (negative polarity) and the second transfer bias voltage is applied to the driving roller at the application amount $V_2'$ (positive polarity) can acquire advantageous effects analogous to the above effects.

This embodiment adopts the driving roller 13 as the opposite member, which forms the secondary transfer nip N2 between the secondary transfer roller 12 and this member and to which the second transfer bias voltage is applied. However, the adoption is not limited thereto. For instance, the member may be a member opposite to the secondary transfer roller (secondary transfer opposite roller), and may be a member following the rotation of the intermediate transfer belt 10.

This embodiment has described that, at the absolute value of the surface potential of the following sheet 22 of 300 (V) or less, double feeding does not occur even if the following sheet 22 is touched with a bare hand. The condition may vary to a certain extent according to the configuration of the secondary transfer section. A value according to the configuration can therefore be adopted.

Embodiment 2

Embodiment 2 will now be described.

Figure 10:
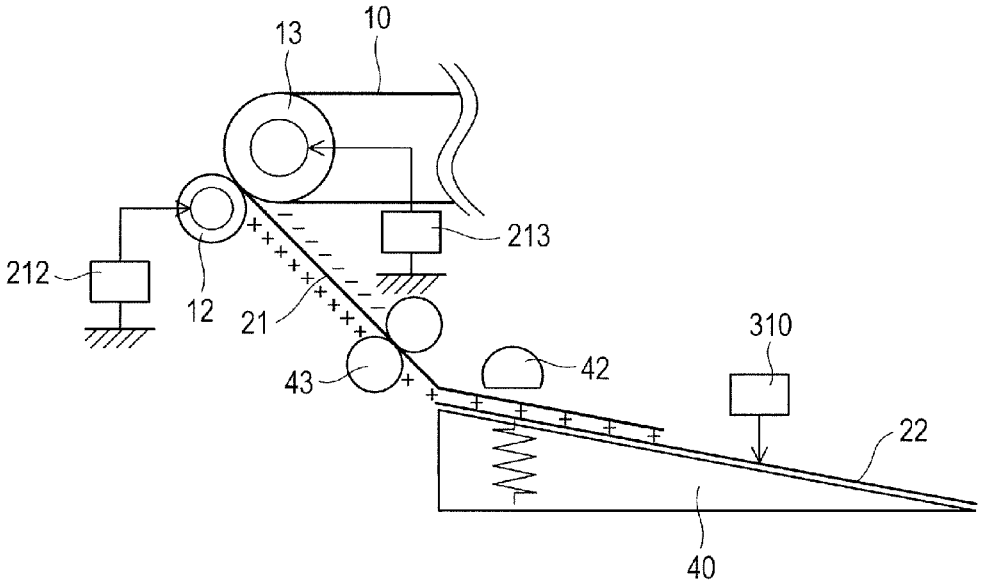
FIG. 10 is a diagram for illustrating a configuration of a secondary transfer section in Embodiment 2.

FIG. 10 is a diagram for illustrating a configuration of a secondary transfer section of this embodiment.

As described in Embodiment 1, in most cases, in the environment for typical usage in an office, measures can be taken by setting the first and second transfer bias voltage application amounts to fixed values such that the surface potential of the following sheet 22 does not become a certain value or more.

However, there are significantly many types of coated sheets. In some materials and thicknesses of the coating layers, there may be a case where the resistance of the surface of the sheet varies. Furthermore, a rare case can be considered in which the sheet left in a high humidity environment to absorb moisture is used in a low humidity environment.

Thus, to securely prevent double feeding due to electrostatic adhesion, even with various types of sheets under every usage situation, the following method can be considered. As illustrated in FIG. 10, the method provides a surface potential measuring device 310 to measure the surface potential of the following sheet 22 on the sheet stack portion 40, and control the first and second transfer bias voltages on the basis of the measured value.

A control method using the surface potential measuring device 310 will hereinafter be described.

Figure 11:
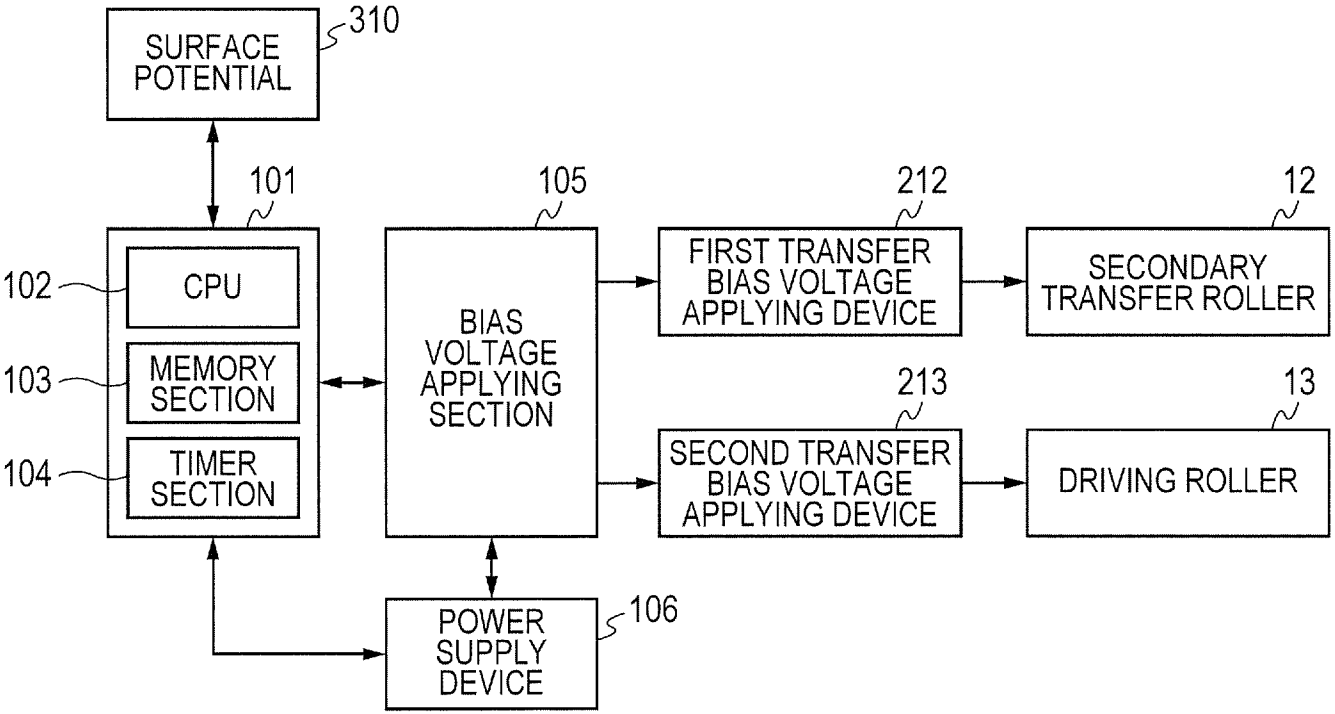
FIG. 11 is a block diagram for illustrating control in Embodiment 2.

FIG. 11 is a control block diagram of this embodiment.

In the secondary transfer of the preceding sheet 21, the surface potential measuring device 310 measures the surface potential of the following sheet 22 at the top on the sheet stack portion 40, and stores the potential in the RAM 102. The CPU 102 causes the bias voltage applying controller 105 to control the bias voltage application amounts of the first transfer bias voltage applying device 212 and the second transfer bias voltage applying device 213.

At this time, the CPU 102 maintains the potential difference required for transfer, and corrects the first and second transfer bias voltages such that the surface potential of the following sheet 22 does not cause double feeding.

A method of correction maintains the absolute value of the difference of the first transfer bias voltage $V_1'$ and the second transfer bias voltage $V_2'$, and sets the offset such that the difference between the absolute values of the first and second transfer bias voltages becomes one of the minimum and zero. The surface potential of the following sheet 22 is determined according to the difference of the absolute values of the first and second transfer bias voltages.

Figure 12:
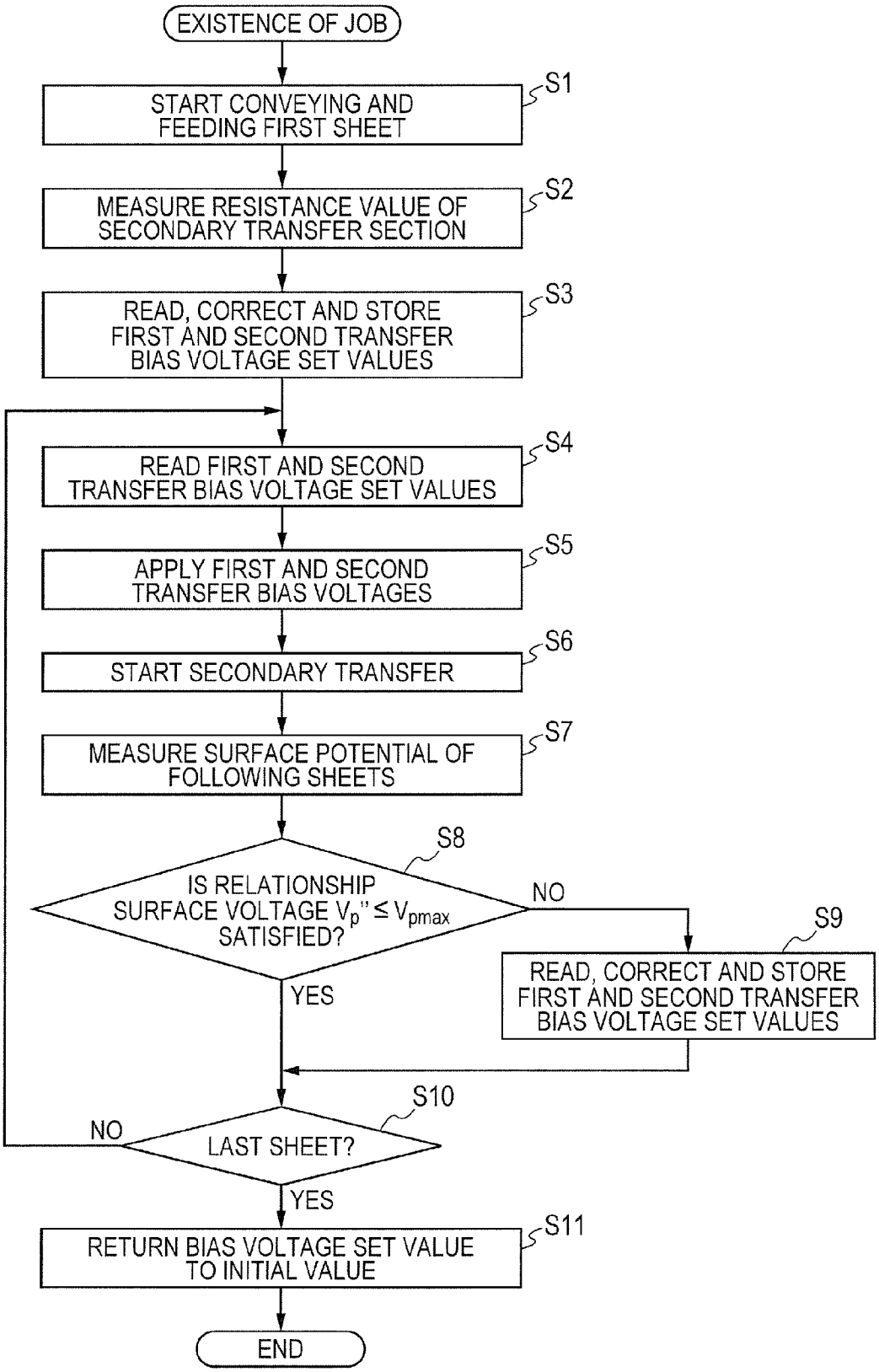
FIG. 12 is a flowchart illustrating transfer bias voltage control executed by a CPU.

FIG. 12 is a flowchart illustrating control of the first and second transfer bias voltages executed by the CPU 102.

After a job is entered, the first sheet is conveyed and fed (S1). The resistance of the secondary transfer section is measured, and corrected values of the first and second transfer bias voltages are calculated (S2). Subsequently, set values of the first and second transfer bias voltages supporting the type and conveying speed of the sheet that are stored in the memory section 103 are read, corrected and stored (S3).

Next, the set values of the first and second transfer bias voltages are read (S4), the first and second transfer bias voltages are applied (S5), and the secondary transfer is started (S6). In the secondary transfer of the preceding sheet, the surface potential $V_P''$ of the following sheet is measured (S7). It is verified whether or not the measured surface potential $V_P''$ satisfies the condition of the surface potential, $V_P'' \leq V_{Pmax}$ (S8). If the condition is satisfied (YES in S8), it is determined whether the sheet is the last sheet in the job or not (S10). If the sheet is the last, each bias voltage set value is returned to the initial value without correction and the process is completed (S11). If the sheet is not the last one, the set values of first and second transfer bias voltages are read to further transfer the following sheet (S4), and the sequence identical to the sequence of the preceding sheet is repeated.

If the value $V_P''$ does not satisfy the relationship of the condition of the surface potential, $V_P'' \leq V_{Pmax}$, i.e., if the value $V_P''$ is larger than the threshold $V_{Pmax}$ (NO in S8), the set values of the first and second transfer bias voltages are read, correction is made to reduce the surface potential $V_P''$, and the correction result is stored (S9). It is then determined whether the sheet is the last or not (S10). Subsequently, the sequence identical to the sequence of the preceding sheet is repeated.

As described above, this embodiment directly measures the surface potential of the following sheet 22 on the sheet stack portion 40, and corrects the first and second transfer bias voltages according to the measurement result. This correction can securely prevent double feeding due to electrostatic adhesion, even with further various types of sheets under every usage situation.

In this embodiment, the surface potential measuring device 310 measures the surface potential of the following sheet 22 on the sheet stack portion 40. However, the measurement is not limited thereto. Instead, the surface potential of the preceding sheet 21 in the secondary transfer may be measured. This measurement is made because the surface potential of the preceding sheet 21 in the secondary transfer is proportional to the surface potential of the following sheet 22 to allow the surface potential of the following sheet 22 to be estimated.

The double feeding due to electrostatic adhesion particularly occurs on the coated sheet. Thus, only in the case where a determination unit determining the type of the sheet determines that the coated sheet is on the sheet stack portion, the control described in this embodiment may be executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-135419, filed Jun. 17, 2011, which is hereby incorporated by reference herein in its entirety.

What is claimed is:

1. An image forming apparatus, comprising:

a main body of the image forming apparatus;

a sheet stack unit including a stack portion on which sheets are stacked, the stack portion including a part exposed from the main body;

an endless intermediate transfer member onto which a toner image is first transferred from an image bearing member;

a first transfer member for transferring the toner image from the intermediate transfer member onto the sheets conveyed from the sheet stack unit, at a nip formed between the intermediate transfer member and the first transfer member;

a second transfer member opposed to the first transfer member via the intermediate transfer member at the nip;

a first voltage applying device that applies a voltage to the first transfer member; and a second voltage applying device that applies a voltage having a polarity opposite to a polarity at the first voltage applying device, to the second transfer member, and a controller that controls the first voltage applying device and the second voltage applying device, wherein in a timing when a leading edge of a first sheet reaches the nip, a trailing edge of the first sheet contacts a second sheet conveyed on said sheet stack unit, and wherein a period in which the controller causes the first voltage applying device and the second voltage applying device to apply the voltages to the first transfer member and the second transfer member, respectively, is at least from a time when secondary transfer of the toner image onto the first sheet is started to a time when the trailing edge of the first sheet stops sliding on the second sheet stacked on the sheet stack portion.

2. An image forming apparatus according to claim 1, wherein a length between the nip and the stack portion in a sheet conveying direction is shorter than a length of any one of the sheets stacked on the stack portion.

3. An image forming apparatus according to claim 1, further comprising a conveyance device that conveys the sheet stacked on the stack portion toward the nip, wherein, when the conveyance device conveys the first sheet, the first sheet slides on the second sheet stacked on the stack portion.

4. An image forming apparatus according to claim 1, wherein, at the stack portion of the sheet stack unit, trailing edges of the sheets stacked on the stack portion are exposed from the main body.

5. An image forming apparatus according to claim 4, wherein, when the leading edge of the first sheet reaches the nip, the trailing edge of the first sheet is exposed from the main body.

6. An image forming apparatus according to claim 1, wherein, after the trailing edge of the first sheet in the secondary transfer is finished sliding on the second sheet stacked on the sheet stack portion, the controller causes only one of the first voltage applying device and the second voltage applying device to apply the voltage.

7. An image forming apparatus according to claim 1, further comprising:

a surface potential measuring device that measures a surface potential of the first sheet in a state where the first sheet is secondarily transferred at the nip.

8. An image forming apparatus according to claim 7, wherein, when an absolute value of a value measured by the surface potential measuring device is larger than a threshold, the controller executes control so as to maintain an absolute value of a difference between a first voltage applied by the first voltage applying device and a second voltage applied by the second voltage applying device, and lower the difference between an absolute value of the first voltage and an absolute value of the second voltage.

9. An image forming apparatus according to claim 1, further comprising:

a surface potential measuring device that measures a surface potential of a second sheet with and on which a trailing edge of the first sheet stacked on the sheet stack unit can contact while sliding, in a condition where the first sheet is secondary-transferred at the nip.

10. An image forming apparatus according to claim 9, wherein, when an absolute value of a value measured by the surface potential measuring device is larger than a threshold, the controller executes control so as to maintain an absolute value of a difference between a first voltage applied by the first voltage applying device and a second voltage applied by the second voltage applying device, and lower the difference between an absolute value of the first voltage and an absolute value of the second voltage.

11. An image forming apparatus according to claim 1, wherein the intermediate transfer member is an endless intermediate transfer belt, and the second transfer member is a stretching roller around which the intermediate transfer belt is looped.

12. An image forming apparatus, comprising:

a main body of the image forming apparatus;

a sheet stack unit including a stack portion on which sheets are stacked, the stack portion including a part exposed from the main body;

an endless intermediate transfer member onto which a toner image is first transferred from an image bearing member;

a first transfer member for transferring the toner image from the intermediate transfer member onto the sheets conveyed from the sheet stack unit, at a nip formed between the intermediate transfer member and the first transfer member;

a second transfer member opposed to the first transfer member via the intermediate transfer member at the nip;

a first voltage applying device that applies a voltage to the first transfer member;

a second voltage applying device that applies a voltage having a polarity opposite to a polarity at the first voltage applying device, to the second transfer member; and a controller that controls the first voltage applying device and the second voltage applying device, wherein the controller can execute a first mode in which voltages are applied from both the first voltage applying device and the second voltage applying device and the toner image is secondarily transferred from the intermediate transfer member onto the first sheet at the nip, and a second mode in which a voltage is applied only from the first voltage applying device and the toner image is secondarily transferred from the intermediate transfer member onto the first sheet at the nip.

13. An image forming apparatus according to claim 12, wherein the controller executes control such that an absolute value of the voltage applied by the first voltage applying device in a case of executing the first mode is smaller than an absolute value of the voltage applied by the first voltage applying device in a case of executing the second mode.

14. An image forming apparatus according to claim 12, further comprising a conveyance device that conveys the sheet stacked on the stack portion toward the nip, wherein, when the conveyance device conveys the first sheet, the first sheet slides on the second sheet stacked on the stack portion.

15. An image forming apparatus according to claim 12, wherein, at the stack portion of the sheet stack unit, trailing edges of the sheets stacked on the stack portion are exposed from the main body.

16. An image forming apparatus according to claim 12, wherein the intermediate transfer member is an endless intermediate transfer belt, and the second transfer member is a stretching roller around which the intermediate transfer belt is looped.

17. An image forming apparatus, comprising:

a main body of the image forming apparatus;

a sheet stack unit including a stack portion on which sheets are stacked, the stack portion including a part exposed from the main body;

an endless intermediate transfer member onto which a toner image is first transferred from an image bearing member;

a first transfer member for transferring the toner image from the intermediate transfer member onto the sheets conveyed from the sheet stack unit, at a nip formed between the intermediate transfer member and the first transfer member;

a second transfer member opposed to the first transfer member via the intermediate transfer member at the nip;

a first voltage applying device that applies a voltage to the first transfer member;

a second voltage applying device that applies a voltage having a polarity opposite to a polarity at the first voltage applying device, to the second transfer member; and a controller that controls the first voltage applying device and the second voltage applying device, wherein the controller can execute a first mode in which voltages are applied from both the first voltage applying device and the second voltage applying device and the toner image is secondarily transferred from the intermediate transfer member onto the first sheet at the nip, and a second mode in which a voltage is applied only from the second voltage applying device and the toner image is secondarily transferred from the intermediate transfer member onto the first sheet at the nip.

18. An image forming apparatus according to claim 17, wherein an absolute value of the voltage applied by the second voltage applying device in a case of executing the first mode is smaller than an absolute value of the voltage applied by the second voltage applying device in a case of executing the second mode.

19. An image forming apparatus according to claim 17, further comprising a conveyance device that conveys the sheet stacked on the stack portion toward the nip, wherein, when the conveyance device conveys the first sheet, the first sheet slides on the second sheet stacked on the stack portion.

20. An image forming apparatus according to claim 17, wherein, at the stack portion of the sheet stack unit, trailing edges of the sheets stacked on the stack portion are exposed from the main body.

* * * * *